United States Patent [19]

Edwards

[11] Patent Number: 5,020,164

[45] Date of Patent: Jun. 4, 1991

[54] INSULATED STOCKING

[76] Inventor: Joseph Edwards, 3513 E. Danish Rd., Salt Lake City, Utah 84096

[21] Appl. No.: 459,269

[22] Filed: Dec. 29, 1989

[51] Int. Cl.[5] ..... A41B 11/01

[52] U.S. Cl. ..... 2/239; 2/243 R

[58] Field of Search ..... 2/61, 239, 240, 241, 2/243 R; 66/177

[56] References Cited

U.S. PATENT DOCUMENTS

| | | | |
|---|---|---|---|
| 3,457,739 | 7/1969 | Frand | 2/239 |
| 4,255,819 | 3/1981 | Klingspor | 2/239 |
| 4,832,010 | 5/1989 | Lerman | 128/165 |

FOREIGN PATENT DOCUMENTS

| | | | |
|---|---|---|---|
| 1137705 | 6/1957 | France | 2/239 |
| 1288805 | 2/1962 | France | 2/239 |
| 85426 | 2/1936 | Sweden | 2/239 |
| 172207 | 12/1934 | Switzerland | 2/239 |

*Primary Examiner*—Werner H. Schroeder
*Assistant Examiner*—Diana L. Biefeld
*Attorney, Agent, or Firm*—Trask, Britt & Rossa

[57] ABSTRACT

An insulating stocking is formed from two pieces of closed-cell neoprene. Each piece is joined to itself along a longitudinal seam; and the pieces are joined to each other along a lateral seam intersecting the longitudinal seams. Two separated 3-way intersections reduce the size and increase the seam strength at the junctures. The closed-cell neoprene has spaced pores formed therethrough and is covered on both surfaces with a moisture permeable fabric to be reversible.

23 Claims, 4 Drawing Sheets

INSULATED STOCKING

BACKGROUND OF THE INVENTION

1. Field

This invention relates to footwear. More particularly, it relates to insulated stockings useful for cold weather activities such as skiing, skating, biking, jogging and walking.

2. State of the Art

Sport stockings for skiing, skating and other sports are typically made of woven materials. Cotton and wool "sweat socks" are well-known articles of wear and are now understood to also be made from a wide variety of fabrics blended using both natural and synthetic fibers. While such stockings have a certain amount of flexibility, they also have a tendency to "ball up" when compressed, for example, by forward bending of the wearer's leg relative to the foot. That is, the user's foot compresses the stocking and, through repeated movement or manipulation of the foot, causes the stocking material to deform and move relative to the foot and collect into a lump. Such stockings are also somewhat limited in insulative value, even though they may provide useful moisture "wicking" and air "breathability." That is, the material facilitates the transfer of perspiration from the skin through the stocking to the footwear (e.g., shoe, boot).

Closed-cell neoprene has been used as stocking material. However, materials heretofore suggested have been water- or air-resistant and in turn have retained or trapped perspiration. Therefore, closed-cell neoprene has not been accepted as a sport stocking, and especially a winter sport stocking, even though it has good insulating characteristics and an elasticity which far exceeds that of the fibrous materials used for stockings. Thus, a stocking of closed-cell neoprene may hug the wearer's foot and have a reduced tendency to "ball up" or form irritative lumps in highly compressed areas.

Any stocking formed of two or more pieces of material will tend to have raised seams which irritate the foot particularly in confining footwear such as ski boots. Junctures of seams, where reinforcement is required to provide for the focused forces, may be particularly irritating and form indentations in the skin and, on occasion, blisters on the wearer's foot. There is a need for a neoprene stocking which may be usable for sports such as skiing, skating and the like.

BRIEF SUMMARY OF THE INVENTION

A seamed thermal insulating stocking is formed of two pieces of flat material. At least one piece is asymmetric in at least one direction so that a four-way seam juncture does not result. Two three-way junctures of sewn seams are formed, and these junctures are offset from each other by a distance equal to 2–10 times the stitch width, for sewn seams.

Three-way junctures require and result in less material at the seam, than four-way junctures. Thus, the potential for irritation from nodes or bumps in the article at the juncture is much reduced.

Furthermore, the use of two three-way junctures distributes stretching forces over two nodes, instead of one. The seams are thus more resistant to tearing.

The offset is preferably formed in the longitudinal direction, parallel to the leg and foot, but may also be formed in the lateral direction, i.e., across the foot.

The preferred material of construction is a flexible, resilient, composite material. This material typically is a closed-cell, foam-like thin sheet formed with a multiplicity of small holes extending through the depth of the sheet and distributed across its surface. One or both surfaces are covered with a flexible, resiliently elastic porous fabric which is adhered to the core surface. The stocking formed therefrom hugs the foot in compression, breathes to permit the escape of moisture or water vapor, has a high insulative value, and acts as a shock absorber.

The most preferred material is described and claimed in U.S. Pat. No. 4,832,010, issued May 23, 1989 to Max Lerman. Material made under this patent which is particularly useful in the present invention is manufactured by Rubatex Corporation, New Bedford, Va., and sold as "R-1400-N N-2-S Perforated".

DESCRIPTION OF THE PREFERRED EMBODIMENTS

Figure 1:
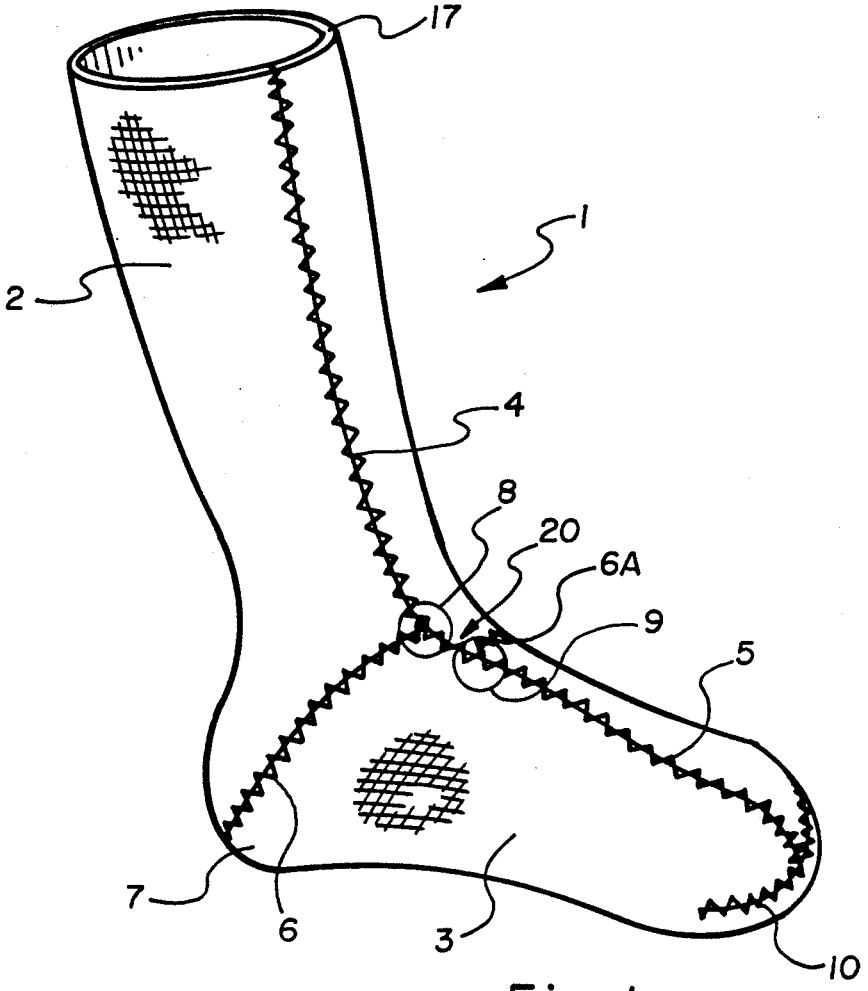
FIG. 1 is a perspective view of a stocking of the invention.

As shown in FIG. 1, an insulated stocking or sock 1 formed of two pieces of material.

An upper or ankle portion 2 is cut from a sheet or roll of material and joined to itself along upper longitudinal seam 4 so that it fits over the ankle and lower leg of the wearer.

Figure 8:
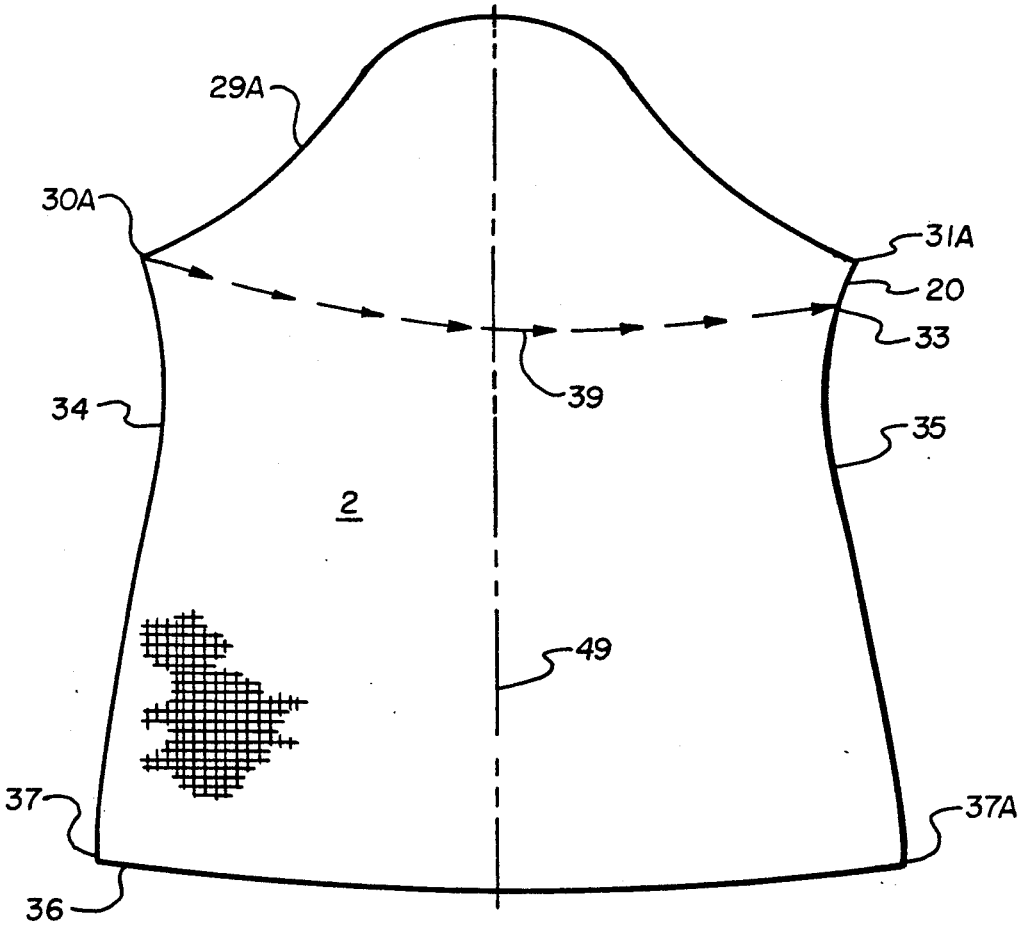

By comparing FIG. 1 and FIG. 8, ankle portion 2 is seen to have a cutting pattern which includes heel edge 29A extending from corner 30A to corner 31A, left edge 34 extending from corner 30A to corner 37, right edge 35 extending from corner 31A to corner 37A and cuff edge 36 extending between corners 37 and 37A. Cuff edge 36 forms the top edge 17 of the stocking 1.

The pattern of ankle portion 2 is asymmetric so that when edge 34 is folded in direction 39 and joined to edge 35, forming seam 4, corner 37 meets corner 37A, but corner 30A is offset from corner 31A meeting edge 35 at juncture 33. Edge 35 is longer than edge 34 by the amount of offset 20.

Figure 7:
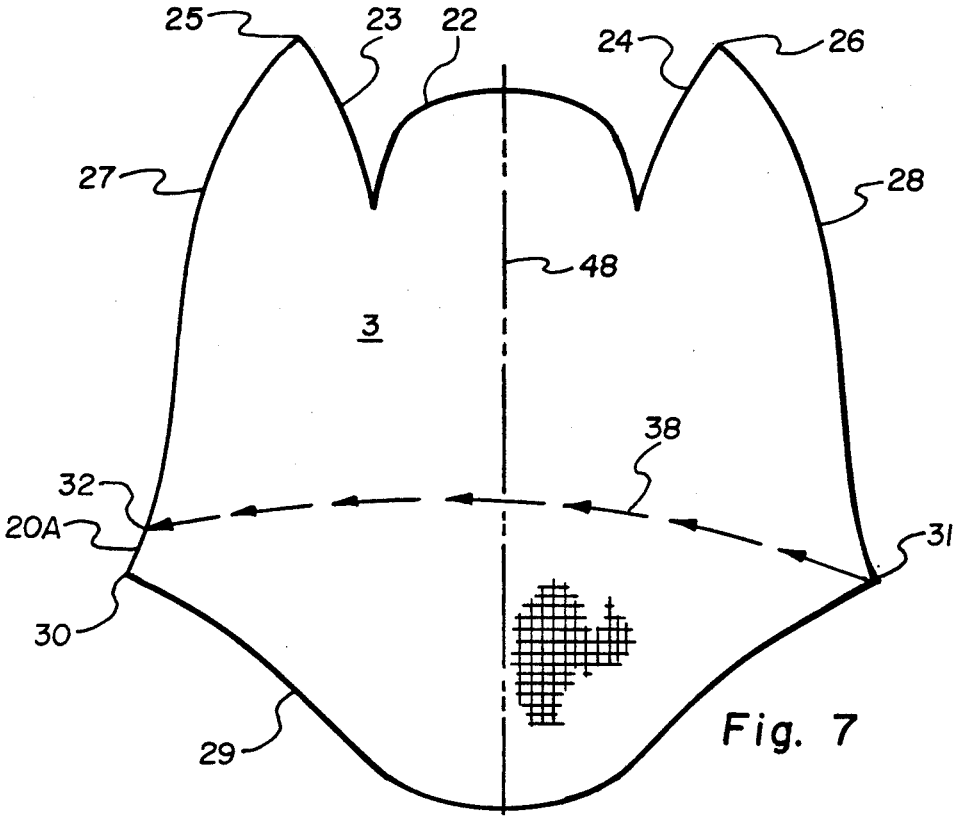
FIGS. 7 and 8 are plan views of the patterns for cutting the material for one embodiment of the invention.

Likewise, as shown in FIGS. 1 and 7, foot portion 3 is similarly cut from material in an asymmetric pattern.

In FIG. 7, the foot portion 3 is seen to be formed by cutting along a bottom toe edge 22, left and right toe edges 23 and 24 respectively, left edge 27 extending from toe point 25 to corner 30, right edge 28 extending from toe point 26 to corner 31, and heel edge 29 extending between corners 30 and 31.

The pattern of foot portion 3 is asymmetric so that when edge 28 is folded in direction 38 and joined to edge 27, forming seam 5 of FIG. 1, toe point 25 meets toe point 26, but corner 31 is offset from corner 30, meeting edge 27 at juncture 32. This offset 20A between corners 30 and 31 is equal in length but opposite in direction to the offset 20 between corners 31A and 30A.

When ankle portion 2 is joined to foot portion 3 by sewing edge or rearward edge 29 to lower edge 29A, the offset portion 20 between corners 30A and 31A is also sewn to the offset portion 20A between corners 30 and 31. Thus corners 31 and 31A meet at juncture 32, forming a three-way juncture 9 of seams 5 and 6A, as seen by comparing FIG. 1 with FIGS. 7 and 8. Likewise, corners 30 and 30A meet at juncture 33, forming a three-way juncture 8 of seams 4 and 6.

In this embodiment, seams 6 and 6A comprise the opposite ends of a single seam. The ends are offset in the assembled stocking, and the central portion of the seam passes to the rear of the wearer's heal pressure point 7. The toe portion of the stocking is formed by joining toe edges 23 and 24 to bottom toe edge 22, forming seam 10 as also illustrated in FIG. 1.

Figure 5:
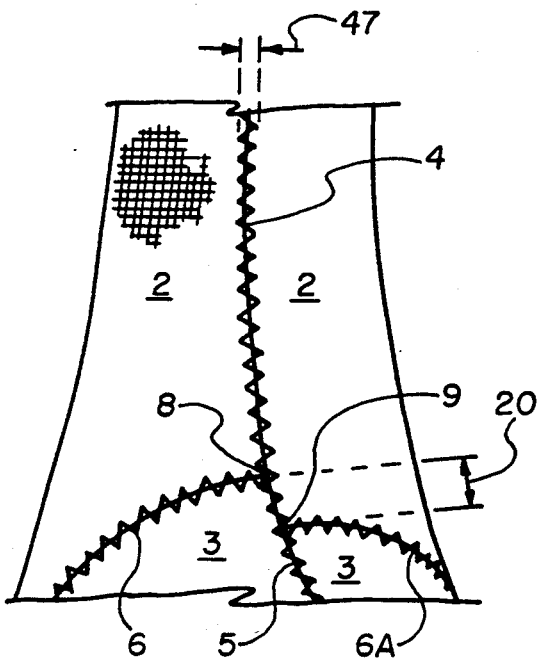
FIG. 5 is a view of the seam junctures in accordance with the embodiment of FIG. 1.

It should be noted that in this embodiment, the offset 20 (see FIG. 5) between junctures 8 and 9 lies along the longitudinal seam 4, 5. In view of the offset 20, there is no major node or rigid seam juncture so that the stocking 1 may be easily folded for packaging or storage. However, it is more significant that the absence of major nodes or rigid seams facilitates comfort in use.

In socks formed of flexible material, seam junctures reinforced by added stitching or other features are less flexible than the base material. Tension forces acting on the material are transmitted along the less flexible seams to the much-less flexible seam junctures. These concentrated forces acting on the junctures result in a tendency to tear at or near the junctures.

The present invention provides two junctures rather than one, to distribute the forces over a wider area. The tendency to tear is greatly reduced.

Furthermore, the three-way junctures such as junctures 8 and 9 require much less reinforcement stitching than a four-way juncture. Thus, a much smaller node of thread and material is formed, to reduce or eliminate any discomfort to the wearer.

To strengthen some seams, the material may be folded over at its edge or overlapped with the adjacent material to increase the strength of the seam and particularly a stitched seam. However, the use of three-way junctures and the neoprene material selected for this embodiment have been found to be of sufficient strength with seams that are virtually indistinguishable from the base material when worn.

The various seams are each placed so that they do not pass over known pressure points of the typical person's foot. Thus, possible irritation is further limited or eliminated.

Figure 4:
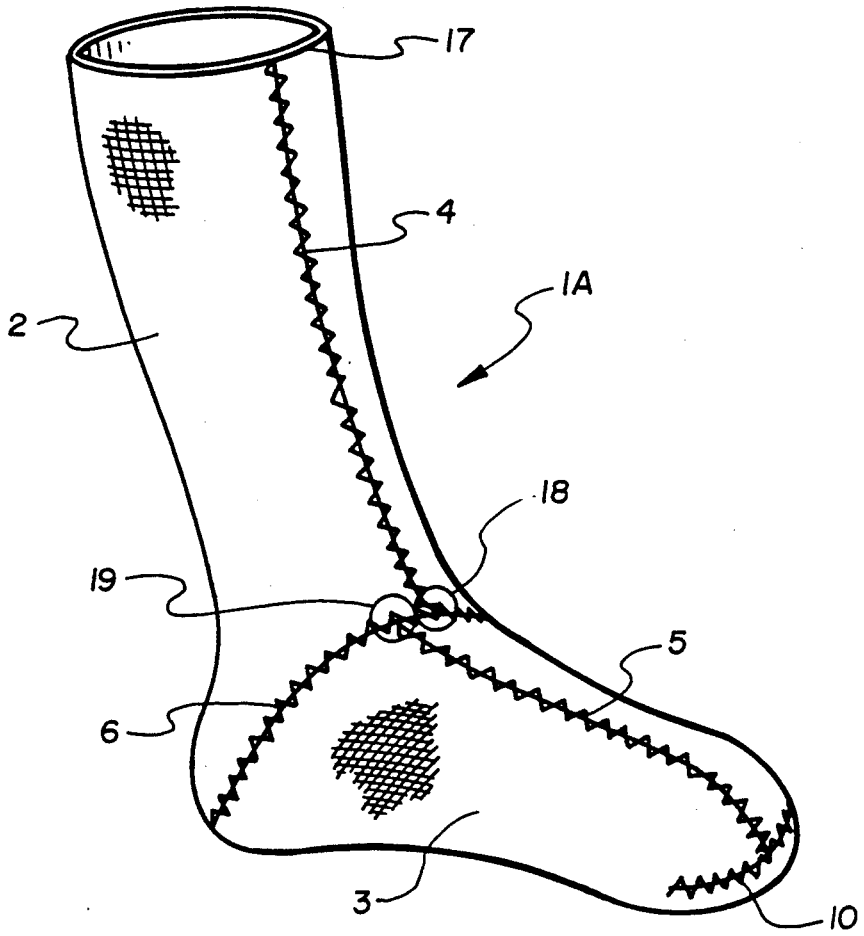
FIG. 4 is a perspective view of another embodiment of the invention.
Figure 6:
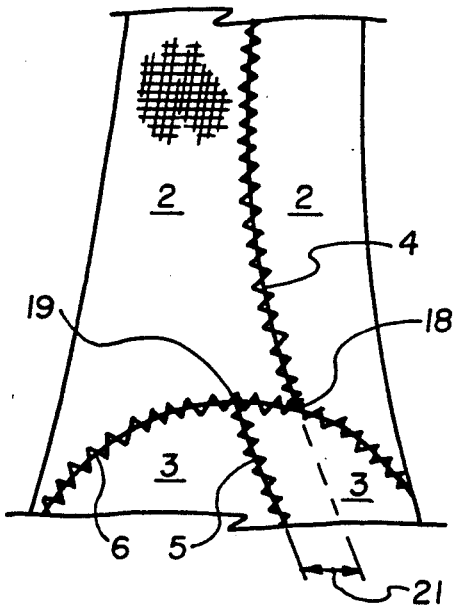
FIG. 6 is a view of the seam junctures in accordance with the embodiment of FIG. 4.
Figure 9:
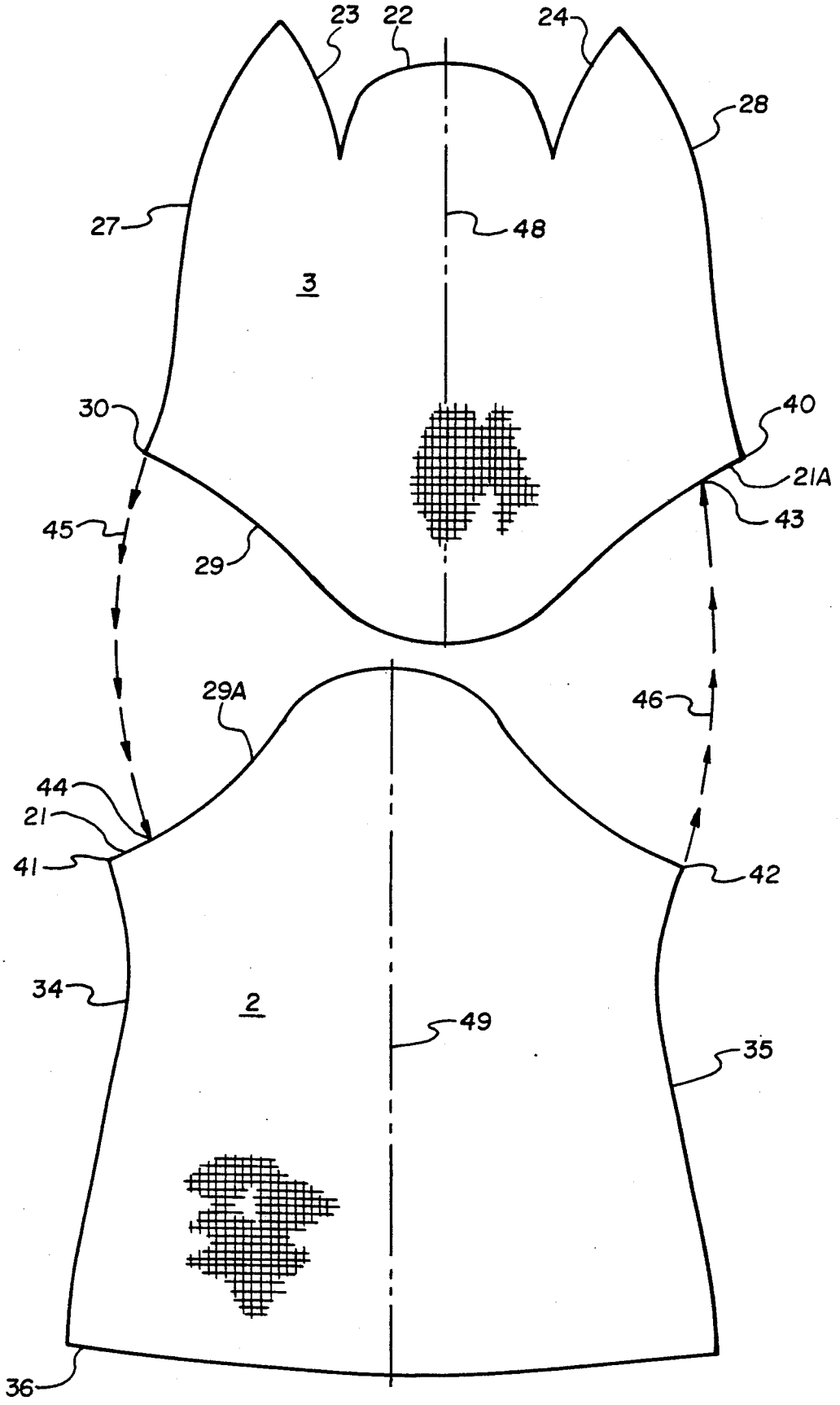
FIG. 9 is a plan view of the patterns for cutting the material in accordance with another embodiment of the invention.

Another embodiment of the invention is illustrated in FIGS. 4, 6 and 9, and forms stocking 1A with a lateral offset 21 between junctures 18 and 19.

In this embodiment, left edge 27 and right edge 28 are equal in length, as are left edge 34 and right edge 35. When ankle portion 2 is joined to foot portion 3, heel edge 29 is offset from heel edge 29A so that corner 30 is joined in direction 45 to juncture 44, separated from corner 41 by offset 21. Likewise, corner 42 is joined in direction 46 to juncture 43, separated from corner 40 by offset 21A equivalent to offset 21. By referring to FIG. 6, seam juncture 18 of seams 4 and 6 is seen as offset 21 from seam juncture 19 of seams 6 and 5. The lateral offset 21 may vary in distance. For a sewn butt seam in the embodiments of FIGS. 5 and 6, offset 20 or 21 may vary from 2 to 15 times the stitch width 47. Thus, for a 2 millimeter (mm) stitch width, the offset may vary from 4 to 30 millimeter (mm). A butt seam is a seam formed by abutting the two edges to be joined rather than overlapping them, folding them, or otherwise reconfiguring the edges for style, strength or some other purpose.

In this invention, sewing is the preferred method for forming the seams. However, other methods such as thermal "welding" or use of adhesives may be applicable in some situations. In general, the offset, whether longitudinal or lateral, should not exceed about 30 mm, regardless of the seam forming method.

In order to achieve the desired offset, at least one of the ankle portion 2 or the foot portion 3 must be asymmetrical with respect to longitudinal axis 48 and/or 49.

In the past, the ankle portion 2 and foot portion 3 were made in a single die-cut piece. It has been discovered that by forming the stocking of two pieces, the number of stockings which may be manufactured from each roll of material is increased by about 20 percent. This yield increase constitutes a major cost savings.

The stocking formed by this invention is particularly useful when constructed of a foam rubber-like material, and particularly a closed-cell neoprene or rubber coated with stretchable fabric and incorporating small spaced holes therethrough for passage of air and water vapor. The material has a high heat insulative value and has sufficient elasticity to stretch easily to conform to the user's foot without being so snug as to cause discomfort. Of course, the product is provided in several sizes to accommodate users having differently sized feet. The material has a resilience so that the stocking acts as a shock absorber or cushion to reduce fatigue and increase comfort. The resilience selected is sufficient to support an upright user without total compression of the material. The preferred material is available from Rubatex Corp. of New Bedford, Va. and is known as R-1400-N-N-2-S Perforated. It has a density such that it weighs about ten pounds per cubic foot.

Figure 2:
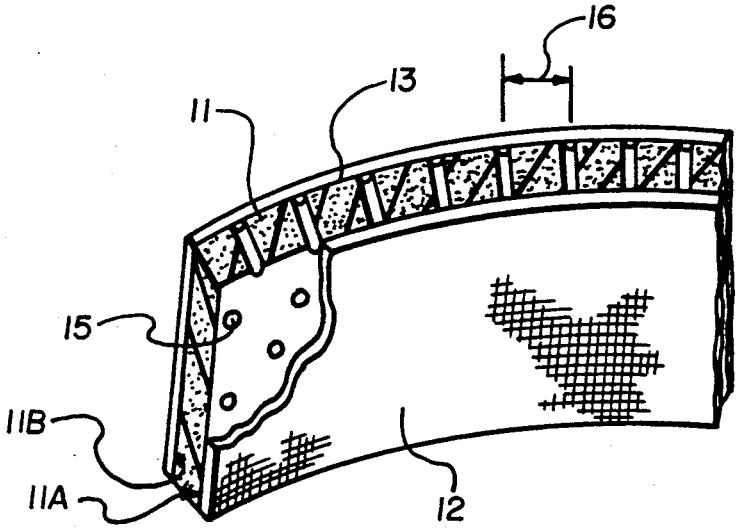
FIG. 2 is an enlarged cutaway view of a portion of the stocking wall of this invention.
Figure 3:
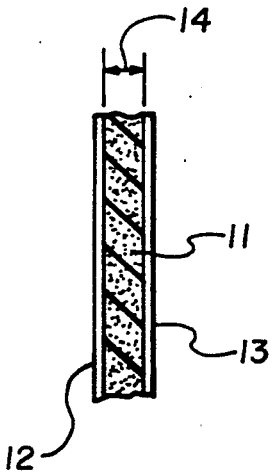
FIG. 3 is an enlarged cross-sectional view of the stocking wall of the invention.

Turning to FIGS. 2 and 3, a cross-section of the preferred material shows closed-cell elastomeric or rubber layer 11, such as neoprene, having a pattern of holes 15 formed through its thickness. The hole spacing 16 may vary from 2 to 12 millimeters (mm). Hole size is typically 0.2–1.0 mm, but may be as large as 2.5 mm. The preferred thickness 14 of the rubber layer 11 is about 1/16 inch but may vary depending on the purpose of the stocking. At least the inside surface or face 11A of the closed-cell material is coated with a flexible elastic fabric 12 adhered to the inside face 11A of the elastomer. This material may be a nylon, terrycloth, a moisture "wicking" cloth such as certain polypropylene materials, or the like. Such material may be adhered to the inside face 11B in a similar fashion. The stocking is reversible, provided that the fabric 12 and 13 on both the inner and outer faces 11A is acceptable for intimate skin contact. The material selected 12, 12 is notably moisture permeable so that the sock will breathe. That is, perspiration from the user may be transmitted through the sock 1, 1A to the footwear (e.g., boot, shoe) then in use.

In the preferred embodiment, the stocking of the invention has numerous advantages. The stocking is essentially free of any irritating unevenness in thickness.

The stocking is open to passage of both air and moisture to provide for comfort and to minimize foot odors. The sock has a high insulative value to keep the wearer's foot warm.

The sock snugly surrounds and may even compress the foot and minimize the tendency to "ball up" in compressed areas.

The stocking may also be made reversible. Also, the stocking has a seam arrangement which results in a stocking which may sustain greater stretching or tension forces and in turn have a larger useful life. Also, the use of a two-piece construction results in a yield of stockings per unit area of material which is increased over one-piece stockings, reducing production costs. The stocking is also quickly and easily made merely by cutting and joining two patterned pieces.

It is to be understood that the invention is not to be limited to the specific embodiments which have been illustrated and described herein, and that further modifications may be made which come within the scope of the present invention as defined by the appended claims.

What is claimed is:

1. A stocking, comprising:

a foot piece formed from flat sheet material to have a longitudinal axis, said foot piece being folded and joined to itself along a first longitudinal seam to surround the foot of a user and to form a rearward edge;

an ankle piece formed from said flat sheet material to have a longitudinal axis, said ankle piece being folded and joined to itself along a second longitudinal seam to surround the ankle area of the leg of a user and to form a lower edge;

a lateral seam formed by joining said rearward edge of said foot piece to said lower edge of said ankle piece to form a cavity to receive the foot of a user, said lateral seam intersecting said first longitudinal seam to form a juncture which is offset from the juncture formed by the intersecting of said second longitudinal seam with said lateral seam; and wherein at least one of said foot piece and said ankle piece is asymmetric about its longitudinal axis.

2. The stocking of claim 1, wherein said first longitudinal seam joins said foot piece along its generally upper side, and said second longitudinal seam joins said ankle piece along its generally front side.

3. The stocking of claim 2, wherein said foot piece has a front edge having joinable portions and a toe seam formed by joining together said joinable portions of said front edge of said foot piece.

4. The stocking of claim 3, wherein the said two junctures are separated laterally along said lateral seam.

5. The stocking of claim 3, wherein said two junctures are separated longitudinally along said first and second longitudinal seams.

6. The stocking of claim 4, wherein said seams are butt seams.

7. The stocking of claim 6, wherein said seams are formed by stitching with thread.

8. The stocking of claim 7, wherein said two junctures are reinforced by an additional stitching.

9. The stocking of claim 8, wherein said stitching joining said pieces has a width across said seams, and said offset separating said junctures is from about two times to about fifteen times said width.

10. The stocking of claim 2, wherein said offset separating said junctures is from about 3 to about 30 millimeters.

11. The stocking of claim 1, wherein said flat sheet material includes:

a base layer of a flexible, foam rubber-like material having holes extending through the sheet and distributed across the surface area of the sheet, and having an elasticity and density selected to resiliently support an upright user, said base layer having a first face and a second face;

an interior layer formed of a fabric which is flexible, moisture permeable, and adhered to said first face; and an exterior layer formed of a fabric which is flexible, moisture permeable and adhered to said second face.

12. The stocking of claim 11, wherein said interior layer and said exterior layer are selected for contact with the skin, said stocking being reversible for alternative use of said interior and exterior layers in skin contact.

13. The stocking of claim 11, wherein said interior layer is an elastic nylon material.

14. The stocking of claim 11, wherein said interior layer is terry cloth material.

15. The stocking of claim 11, wherein said interior layer is a moisture wicking material.

16. The stocking of claim 11, wherein said base layer is closed-cell neoprene material.

17. The stocking of claim 11 wherein said base layer is closed-cell elastomeric foam material.

18. A stocking comprising:

a foot piece formed from flat sheet material to have a longitudinal axis, said foot piece being folded and joined to itself along a first longitudinal seam to surround the foot of a user and to form a rearward edge;

an ankle piece formed from flat sheet material to have a longitudinal axis, said ankle piece being folded and joined to itself along a second longitudinal seam to surround the ankle area of the leg of a user and to form a lower edge; and a lateral seam formed by joining said rearward edge of said foot piece to said lower edge of said ankle piece to form a cavity to receive the foot of a user, said lateral seam intersecting said first longitudinal seam to form a juncture which is offset from the juncture formed by the intersecting of said second longitudinal seam with said lateral seam;

wherein at least one of said foot piece and said ankle piece is asymmetric about its longitudinal axis; and wherein said flat sheet material includes a base layer of a flexible, foam rubber-like material having a plurality of holes extending through the said flat sheet and having an elasticity and density selected to resiliently support an upright user, said base layer having a first face and a second face, an interior layer formed of a fabric which is moisture permeable, and adhered to said first face, and an exterior layer formed of a fabric which is flexible, moisture permeable and adhered to said second face.

19. The stocking of claim 18, wherein said first longitudinal seam joins said foot piece along its generally upper side, and said second longitudinal seam joins said ankle piece along its generally front side and wherein said foot piece has a front edge having joinable portions and a toe seam formed by joining together said joinable portions of said front edge of said foot piece.

20. The stocking of claim 19, wherein said interior layer and said exterior layer are selected for contact with the skin, said stocking being reversible for alternative use of said interior and exterior layers in skin contact.

21. The stocking of claim 20, wherein the said two junctures are separated laterally along said lateral seam, and wherein said seams are formed by stitching with thread.

22. The stocking of claim 21, wherein said stitching joining said pieces has a width across said seams, and said offset separating said junctures is from about two times to about fifteen times said width, and wherein said base layer is closed-cell neoprene material.

23. A method of fabricating a stocking comprising:

providing a quantity of flexible foam-rubber like material;

forming a foot piece from said flexible foam rubber-like material to be asymmetric and to have a longitudinal axis;

folding and joining said foot piece to itself to form a first longitudinal seam to surround the foot of a user and to form a rearward edge;

forming an ankle piece from said flexible foam rubber-like material to be asymmetric and to have a longitudinal axis;

folding an joining said ankle piece to itself to form a second longitudinal seam and a lower edge to surround the leg of a user in the ankle area; and joining said ankle piece at its lower edge to the foot piece at its rearward edge to form a lateral seam, said lateral seam intersecting said first and second longitudinal seams at two junctures which are offset from each other, to form a cavity to enclose the user's foot.

* * * * *

UNITED STATES PATENT AND TRADEMARK OFFICE

CERTIFICATE OF CORRECTION

PATENT NO. : 5,020,164

DATED : JUNE 4, 1991

INVENTOR(S) : JOSEPH L. EDWARDS

It is certified that error appears in the above-identified patent and that said Letters Patent is hereby corrected as shown below:

Col. 3, line 20, delete "heal" and insert ---heel---.

Col. 4, line 64, delete "12" second occurence.

Col. 8, line 10, delete "an" and add ---and---.

Col. 6, line 59, insert ---flexible,---after "is" and before "moisture".

Signed and Sealed this

Thirtieth Day of March, 1993

*Attest:*

STEPHEN G. KUNIN

*Attesting Officer*

*Acting Commissioner of Patents and Trademarks*